United States Patent [19]

Blakeway

[11] 4,357,109

[45] Nov. 2, 1982

[54] MIXER

[76] Inventor: Stanley R. Blakeway, 26 Barbigal St., Stafford, Queensland, Australia, 4053

[21] Appl. No.: 169,263

[22] Filed: Jul. 15, 1980

[30] Foreign Application Priority Data

Jul. 18, 1979 [AU] Australia ..... PD 9621

[51] Int. Cl.[3] ..... B28C 5/20; B28C 7/16

[52] U.S. Cl. ..... 366/55; 366/47; 366/56; 366/62; 366/63

[58] Field of Search ..... 366/42, 45, 47, 48, 366/53, 54, 57, 60, 62, 63, 185, 189, 55, 46, 56, 184

[56] References Cited

U.S. PATENT DOCUMENTS

| | | | |
|---|---|---|---|
| 2,981,524 | 4/1961 | Yager | 366/48 |
| 3,084,917 | 4/1963 | Graybill | 366/48 |
| 4,078,263 | 3/1978 | Campbell | 366/53 |

FOREIGN PATENT DOCUMENTS

| | | | |
|---|---|---|---|
| 123147 | 1/1947 | Australia | 366/48 |
| 1058251 | 3/1963 | United Kingdom . | |
| 1311415 | 3/1973 | United Kingdom . | |
| 1517535 | 7/1978 | United Kingdom . | |

*Primary Examiner*—Harvey C. Hornsby
*Assistant Examiner*—Joseph M. Pitko
*Attorney, Agent, or Firm*—Schwartz, Jeffery, Schwaab, Mack, Blumenthal & Koch

[57] ABSTRACT

A mixer for concrete or other materials has a bowl rotatably mounted on a frame provided with handles and with support means, which, by moving the frame to one position, will hold the bowl in a charging and mixing position supported clear of the ground, its axis inclining up to its mouth. The frame can also be moved to bring the bowl to a travelling position to be propelled along the ground, its axis inclining upwardly towards the mouth. To discharge the mixer, the frame is movable to a further position, the bowl supported by the support means, above the ground with its axis inclining downwardly towards its mouth. The bowl may be rotated, when in mixing or travelling or discharging position, by a motor on the frame and operatively connected to the bowl, the mixer being steered by the handles when propelled with the bowl in travelling position.

5 Claims, 6 Drawing Figures

MIXER

BACKGROUND OF THE INVENTION

This invention relates to a mixer.

One kind of mixer to which the invention is particularly applicable is a concrete mixer. Such a device ordinarily has a drum with internal vanes or ribs mounted on a frame and driven by a motor, or sometimes manually, the axis of the drum inclining upwardly towards its open mouth. When the ingredients are sufficiently mixed, the concrete is tipped into a wheelbarrow or skip for transport to the point of use. The transporting of the concrete is vary laborious, particularly if inclines have to be negotiated.

The present invention has been devised with the general object of providing a mixer, usable for mixing concrete or for mixing top-dressing and fertilizer for a lawn, for example, the mixer being usable to transport the mixed materials to the required location and there discharge them. Other objects achievable in preferred embodiments of the invention are to provide a mixer which is particularly simple and economical to manufacture, easy to operate and to move, and sturdy and durable in use.

BRIEF SUMMARY OF THE INVENTION

According to the invention, a mixer is generally of the type having a frame, and a bowl rotatably mounted on the frame and with a mouth for feeding materials to be mixed into the bowl and for discharging the mixture from the bowl. The frame is made with support means adapted to support the frame as that the bowl is in a mixing position above the ground, its axis inclining upwardly towards the bowl mouth, the frame being movable to lower the bowl to a travelling position resting on the ground with its axis inclining upwardly towards the mouth, and the frame being further movable to bring the bowl to a discharging position, supported above the ground by the support means with its axis inclining downwardly towards the mouth. The frame includes handles for manually steering the mixer when the mixer is propelled with the bowl in its travelling position. Preferably a motor is mounted on the frame and is connected to the bowl by a suitable drive mechanism to rotate it in any of its mixing, travelling or discharging positions. One or more wheels may be mounted on the frame for stabilizing the bowl in its travelling position. Other features of the invention will become apparent from the following description.

BRIEF DESCRIPTION OF THE DRAWINGS

In order that a preferred embodiment of the invention may be readily understood and carried into practical effect, reference is now made to the accompanying drawings, wherein.

DETAILED DESCRIPTION OF THE PREFERRED EMBODIMENT

Figure 1:
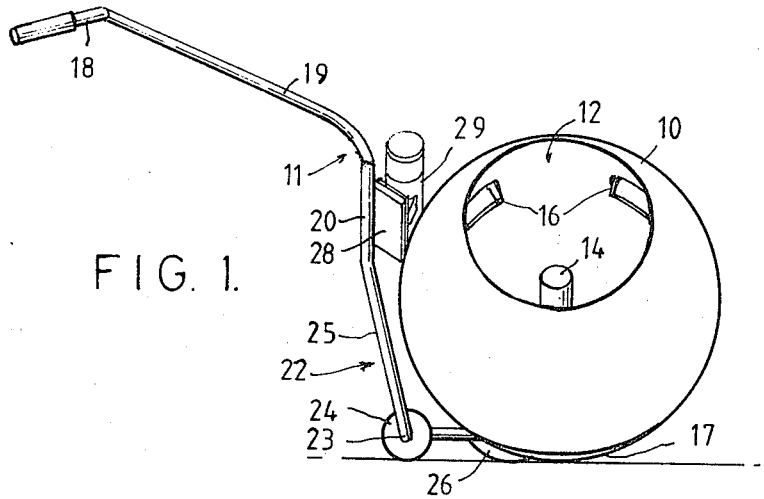
FIG. 1 is a right-hand side elevation of a mixer according to the invention, its bowl in travelling position.
Figure 2:
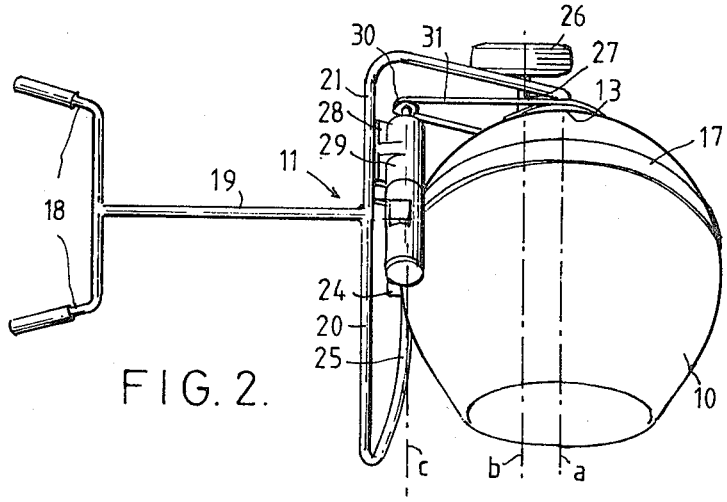
FIG. 2 is a plan view of the mixer.
Figure 3:
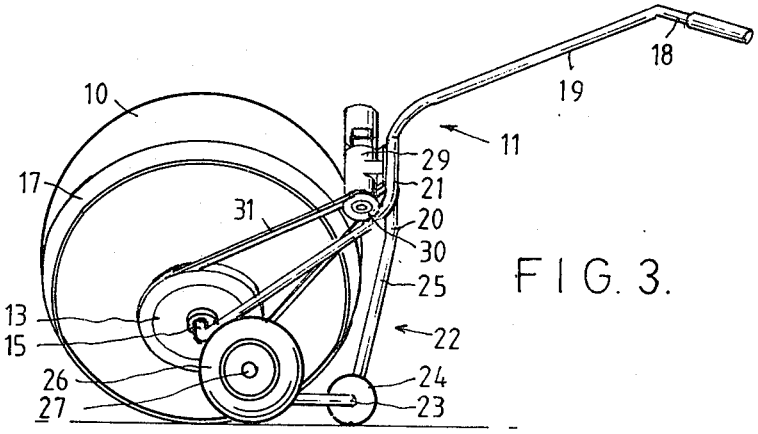
FIG. 3 is a left-hand side view of the mixer.
Figure 4:
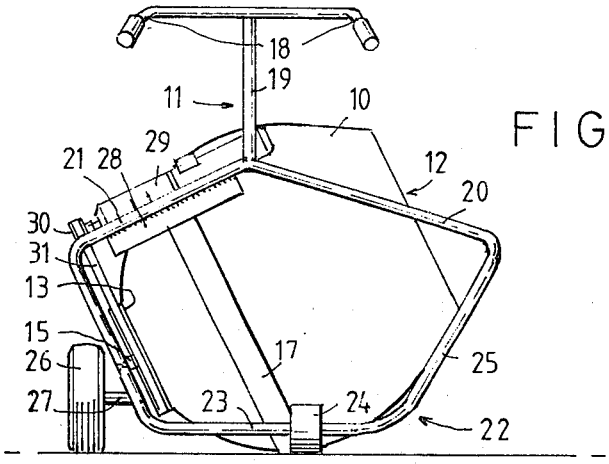
FIG. 4 is a rear view of the mixer.

The mixer illustrated includes a bowl 10 mounted rotatably on a frame 11. The bowl may be moulded of a tough plastics material or fabricated of metal, and it is for the greater part a spherical zone, developing at one end to frusto-conical shape about a mouth 12, and at the opposite end having a flattened part to which a pulley wheel 13 is secured. Within the bowl there is fixed an axial shaft bearing housing 14 which is rotatably mounted on a bowl shaft 15 fixed on the frame 11, this shaft passing through the pulley wheel 13 and the adjacent end of the bowl. Mixing vanes or ribs 16 are provided within the bowl, and a tire or tread 17 is secured about the bowl nearer to the pulley wheel 13 than to the bowl mouth 12.

The frame 11 is made mainly of tubular metal, and it includes a pair of handles 18 fixed to the rear of a top bar 19 which at its front is secured to a right-hand bar 20 and a left-hand bar 21 to the front and bottom end of which the bowl shaft 15 is fixed.

A single bar 22 is rigidly secured at its ends to the extremities of the right-hand and left-hand bars 20 and 21, and is shaped to form, at its middle part, an axls 23 for a roller 24 and, between the roller 24 and the right-hand bar 20, a roll bar 25. A stabilizer wheel 26 is mounted on an axle 27 fixed to the bar 22 near to its connection to the left-hand bar 21, the stabilizer wheel axle 27 being parallel to the roller axle 23.

A motor mounting plate 28 is secured to the top part of the left-hand bar 21 to provide a support for an electric motor 29 the shaft of which carries a small pulley wheel 30 connected by an endless belt 31 to the pulley wheel 13 on the bowl.

The parts are so made and arranged that the mixer normally rests, as shown in FIGS. 1, 2, 3 and 4, on the tire 17 of the bowl 10, on the stabilizer wheel 26 and on the roller 24. When the mixer is in this position, the axes of the bowl 10, the stabilizer wheel 26 and the roller 24 are in parallel vertical planes indicated, respectively, at a, b and c in FIG. 2, the axis of the bowl 10 being at an angle to horizontal, the parallel axles of the stabilizer wheel and roller being horizontal.

Figure 5:
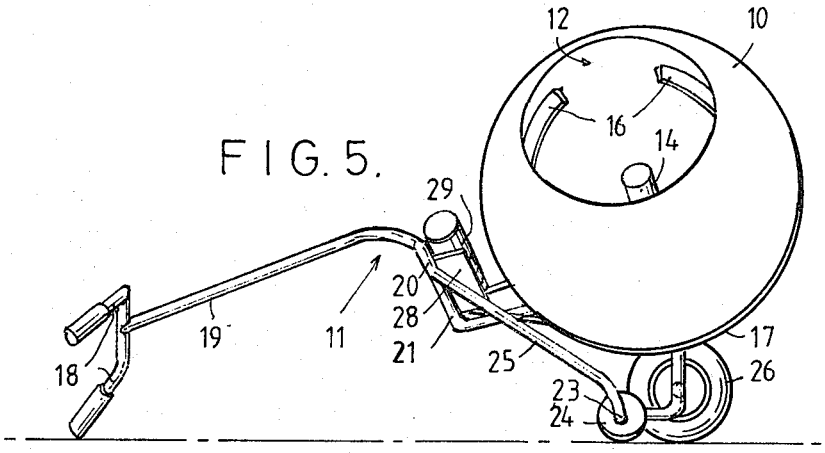
FIG. 5 is a right-hand side view of the mixer with its bowl in charging and mixing position.
Figure 6:
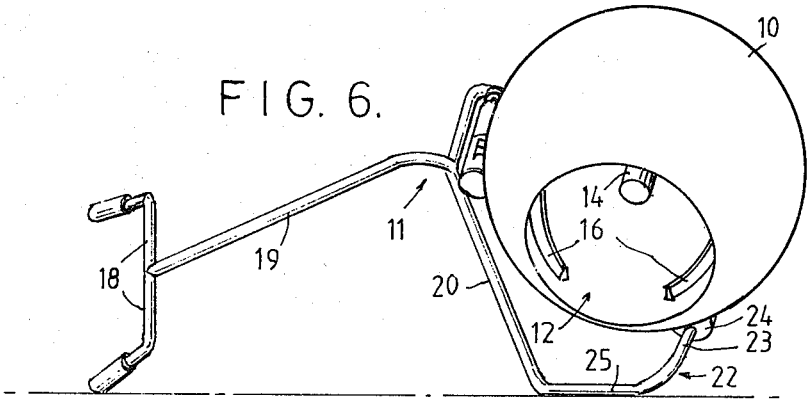
FIG. 6 is a right-hand side view of the mixer with its bowl in discharging position.

If the handles 18 are depressed to pivot the frame 11 about the stabilizer wheel 26 and the roller 24, which is behind the stabilizer wheel, the mixer bowl 10 is brought to its charging and mixing position as shown in FIG. 5, the bowl 10 being lifted clear of the ground, its axis being in a vertical plane at an angle to the parallel vertical planes containing the axes of the stabilizer wheel 26 and roller 24, the frame 11 being supported at the rear by the left-hand handle 18. The motor 29 may be operated to rotate the raised bowl 10 as or after the material to be mixed is being or has been fed through the mouth 12.

To transport the mixture to a different site, the handles 18 are lifted to bring the mixer bowl to its travelling position as shown in FIGS. 1, 2, 3 and 4, the bowl tire 17 being on the ground so that, as the bowl is rotated by the motor 29, the mixer is driven forwards. The axis of the bowl is tilted to horizontal, but because it lies in a vertical plane parallel to the vertical planes through the axes of the stabilizer wheel and roller, the mixer may be easily steered, by means of the handles 18, as it progresses and, of course, the mixing of the materials continues during this travel.

To discharge the contents of the bowl, the handles 18 are lowered and twisted to cause the stabilizer wheel to be raised clear of the ground and the frame to turn about the roller 24 to bring the roll bar 25 onto the ground, supporting the bowl in a raised position with its mouth 12 directed downwardly. As the bowl is rotated, its contents will be discharged. When the bowl has been emptied, the mixer may be returned to its travelling position to be steered back to the location for refilling and mixing a further batch of the material, and so on.

The mixer will be found to be simple and economical to manufacture, and, in many applications, to be far more convenient and labour saving than conventional mixers. The provision of the stabilizer wheel 26 and roller 24 enables the mixer to be conveniently and easily handled even when it is of fairly large size capable of mixing large amounts of concrete or other materials. For a small-size mixer, however, the stabilizer wheel and roller may be omitted, the bowl, when in mixing position, being supported on the bar 22. In a small and inexpensive mixer the power drive may also be omitted, the mixing of materials in the bowl being effected simply by propelling the mixer manually to rotate the bowl.

I claim:

1. A mixer comprising:

(a) a mixing bowl having an axis of rotation, a mouth at one end for loading and discharge, and a peripheral portion which engages the ground when the mixer travels to a discharge site;

(b) a frame including first support means supporting said bowl in a mixing position above the ground, in which mixing position the axis of said bowl is inclined upwardly in a direction transverse to the direction of travel of the mixer, said frame being movable to lower said bowl to a travelling position in which said peripheral portion of said bowl engages the ground, the axis of said bowl in such travelling position being similarly inclined upwardly to permit mixing to continue;

(c) said frame including second support means which, when said bowl is moved to a discharging position, supports said bowl above the ground, with the axis of said bowl in such discharging position inclining downwardly, and (d) a handle attached to said frame for steering the mixer when the mixer is propelled with said bowl in said travelling position, said handle being moved parallel to the direction of travel of said mixer when the bowl is moved from its mixing position to its travel position, and being moved transversely to the direction of travel of said mixer when said bowl is moved from said travelling position to a discharge position.

2. A mixer according to claim 1 wherein a motor is mounted on said frame and operatively connected to and adapted to rotate said bowl in its mixing, travelling or discharging position.

3. A mixer according to claim 2 wherein said first support means further comprises:

(a) a first wheel located near the end of said bowl opposite said bowl mouth, and (b) a second wheel located behind said bowl when said bowl is in said travelling position.

4. A mixer according to claim 3 wherein said second support means comprises a roll bar adapted to support said bowl above the ground when said bowl is in said discharging position.

5. A mixer according to claim 4 wherein vertical planes through the axis of said bowl, and axes of said first wheel and said second wheel are parallel when said bowl is in said travelling position, said axis of said bowl inclining upwardly toward said bowl mouth.

* * * * *